US011312586B2

(12) United States Patent
Nishiyama

(10) Patent No.: US 11,312,586 B2
(45) Date of Patent: Apr. 26, 2022

(54) SHEET STORAGE APPARATUS AND IMAGE FORMING APPARATUS

(71) Applicant: CANON KABUSHIKI KAISHA, Tokyo (JP)

(72) Inventor: Tatsuo Nishiyama, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/898,496

(22) Filed: Jun. 11, 2020

(65) Prior Publication Data

US 2020/0399081 A1 Dec. 24, 2020

(30) Foreign Application Priority Data

Jun. 24, 2019 (JP) ..... JP2019-116799

(51) Int. Cl.
*B65H 1/14* (2006.01)
*B65H 1/26* (2006.01)
*B65H 7/02* (2006.01)

(52) U.S. Cl.
CPC ..... *B65H 1/266* (2013.01); *B65H 1/14* (2013.01); *B65H 7/02* (2013.01); *B65H 2801/03* (2013.01)

(58) Field of Classification Search
CPC ..... B65H 1/00; B65H 2405/00; B65H 2405/1116; B65H 2405/112;
(Continued)

(56) References Cited

U.S. PATENT DOCUMENTS 5,333,852 A * 8/1994 Milillo ..... B65H 1/04 271/171
6,070,048 A * 5/2000 Nonaka ..... B65H 1/00 399/376

(Continued)

FOREIGN PATENT DOCUMENTS

JP H10-1227 A 1/1998
JP 2002-145459 A 5/2002

(Continued)

OTHER PUBLICATIONS

Machine translation of JP10-1227. (Year: 1998).*

*Primary Examiner* — Thomas A Morrison
(74) *Attorney, Agent, or Firm* — Venable LLP

(57) ABSTRACT

A sheet storage apparatus includes an apparatus body, a sheet storage portion attachable/detachable to/from the apparatus body, a regulating portion to regulate a position of an end portion of the sheet stored in the storage portion, a cam member slidably movable by interlocking with a movement of the regulating portion, and a slide member supported on the apparatus body and slidably movable by engaging with the cam member in a case where the storage portion is attached to the apparatus body. A sensor includes a moving portion supported on the apparatus body and movable by engaging with the slide member, and a variable resistor, supported on the apparatus body, whose resistance value varies in response to a position of the moving portion in the second direction. The sensor outputs a detection value that varies in response to the resistance value of the variable resistor.

18 Claims, 12 Drawing Sheets

(58) Field of Classification Search
CPC ..... B65H 2405/113; B65H 2405/114; B65H 2511/10; B65H 2511/12; B65H 2701/1131; B65H 1/14; B65H 1/266
See application file for complete search history.

(56) References Cited

U.S. PATENT DOCUMENTS

| | | | | |
|---|---|---|---|---|
| 6,254,085 | B1 * | 7/2001 | Kang | B65H 1/266 271/171 |
| 7,540,677 | B2 * | 6/2009 | Allwright | B41J 13/103 271/162 |
| 10,053,310 | B2 | 8/2018 | Nishiyama et al. | |
| 2006/0087072 | A1 * | 4/2006 | Kwon | B65H 1/04 271/171 |
| 2006/0180981 | A1 * | 8/2006 | Miki | B65H 1/266 271/10.13 |

FOREIGN PATENT DOCUMENTS

| | | | |
|---|---|---|---|
| JP | 3090170 | A | 11/2002 |
| JP | 3090170 | U | 11/2002 |

* cited by examiner

SHEET STORAGE APPARATUS AND IMAGE FORMING APPARATUS

BACKGROUND OF THE INVENTION

Field of the Invention

The present invention relates to a sheet storage apparatus configured to store a sheet and to an image forming apparatus including the same.

Description of the Related Art

In general, an image forming apparatus such as a printer includes a cassette configured to store a sheet and to be attachable/detachable to/from an apparatus body of the image forming apparatus. The image forming apparatus forms an image on the sheet fed from the cassette. The cassette is arranged to be able to store various size sheets, and a technology for detecting the size of the sheet within the cassette is being proposed.

Hitherto, there has been proposed a sheet size detecting mechanism comprising side plates for regulating a widthwise position of a sheet stored within a cassette and a sliding variable resistor as disclosed in Japanese Patent Application Laid-open No. H10-1227 for example. The sliding variable resistor includes a cap slidably movable in a cassette attaching/detaching direction and varies a resistance value in response to a position of the cap. The cassette is provided with a lever pivotably supported centering on a support shaft. A circular arc long hole is formed at a first end of the lever and a long hole extending in a width direction is formed at a second end of the lever. A boss of the side plate engages with the circular arc long hole and a pressing member engages with the long hole extending in the width direction. The pressing member is disposed engageably with the cap of the sliding variable resistor.

When the side plate is moved in the width direction, the lever and the pressing member are interlocked and a position of the pressing member in the cassette attaching/detaching direction varies. Then, when the cassette is attached to the apparatus body, the pressing member moves the cap of the sliding variable resistor and varies the resistance value of the sliding variable resistor. The size of the sheet within the cassette is judged based on the variation of the resistance value.

However, the sheet size detecting mechanism disclosed in Japanese Patent Application Laid-open No. H10-1227 uses the lever pivoting centering on the support shaft and the pressing member slidably moving with respect to the lever. The pressing member is provided to absorb a distance between the second end of the lever and the cap of the sliding variable resistor when the lever pivots, and the larger the movable range of the side plate, the greater a moving distance of the pressing member to the lever becomes.

Thus, because the lever pivots centering on the support shaft by interlocking with the move in the width direction of the side plate in the sheet size detecting mechanism disclosed in Japanese Patent Application Laid-open No. H10-1227, a pressing member is additionally required to detect a position of the side plate in a predetermined range. Therefore, a component tolerance caused by the pressing member is added, becoming a factor of dropping detection accuracy of the sheet size.

SUMMARY OF THE INVENTION

According to a first aspect of the present invention, a sheet storage apparatus, including an apparatus body, a storage portion configured to be attachable/detachable to/from the apparatus body and to store a sheet, a regulating portion configured to slidably move in a first direction with respect to the storage portion and to regulate a position of an end portion, in the first direction, of the sheet stored in the storage portion, a cam member provided in the storage portion and configured to slidably move in a second direction by interlocking with a movement of the regulating portion in the first direction, the second direction intersecting with the first direction and being along an attaching/detaching direction of the storage portion, a slide member provided in the apparatus body and configured to slidably move in the second direction by engaging with the cam member in a case where the storage portion is attached to the apparatus body, and a sensor including a moving portion and outputting a detection value that varies in response to a position of the moving portion in the second direction, the moving portion slidably moving in the second direction by engaging with the slide member.

According to a second aspect of the present invention, a sheet storage apparatus, including an apparatus body, a storage portion configured to be attachable/detachable to/from the apparatus body and to store a sheet, a regulating portion configured to slidably move in a first direction with respect to the storage portion and to regulate a position of an end portion, in the first direction, of the sheet stored in the storage portion, a cam member provided in the storage portion and configured to slidably move in a second direction by interlocking with a movement of the regulating portion in the first direction, the second direction intersecting with the first direction and being along an attaching/detaching direction of the storage portion, a slide member provided in the apparatus body and configured to slidably move in the second direction by engaging with the cam member in a case where the storage portion is attached to the apparatus body, and a sensor including a rotary member and outputting a detection value in response to a rotational phase of the rotary member, the rotary member rotates by a movement of the slide member in the second direction.

According to a third aspect of the present invention, an image forming apparatus, including an apparatus body including an image forming unit configured to form an image on a sheet, a storage portion configured to be attachable/detachable to/from the apparatus body and to store the sheet, a regulating portion configured to slidably move in a first direction with respect to the storage portion and to regulate a position of an end portion in the first direction of the sheet stored in the storage portion, a cam member provided in the storage portion and configured to slidably move in a second direction by interlocking with a movement of the regulating portion in the first direction, the second direction intersecting with the first direction and being along an attachment/detachment direction of the storage portion, a slide member provided in the apparatus body and configured to slidably move in the second direction by engaging with the cam member in a case where the storage portion is attached to the apparatus body, a sensor including a moving portion and outputting a detection value that varies in response to a position of the moving portion in the second direction, the moving portion slidably moving in the second direction by engaging with the slide member, and a control portion configured to detect a size of the sheet stored in the storage portion based on the detection value outputted by the sensor.

Further features of the present invention will become apparent from the following description of exemplary embodiments with reference to the attached drawings.

DESCRIPTION OF THE EMBODIMENTS

First Embodiment

Overall Configuration

Figure 1:
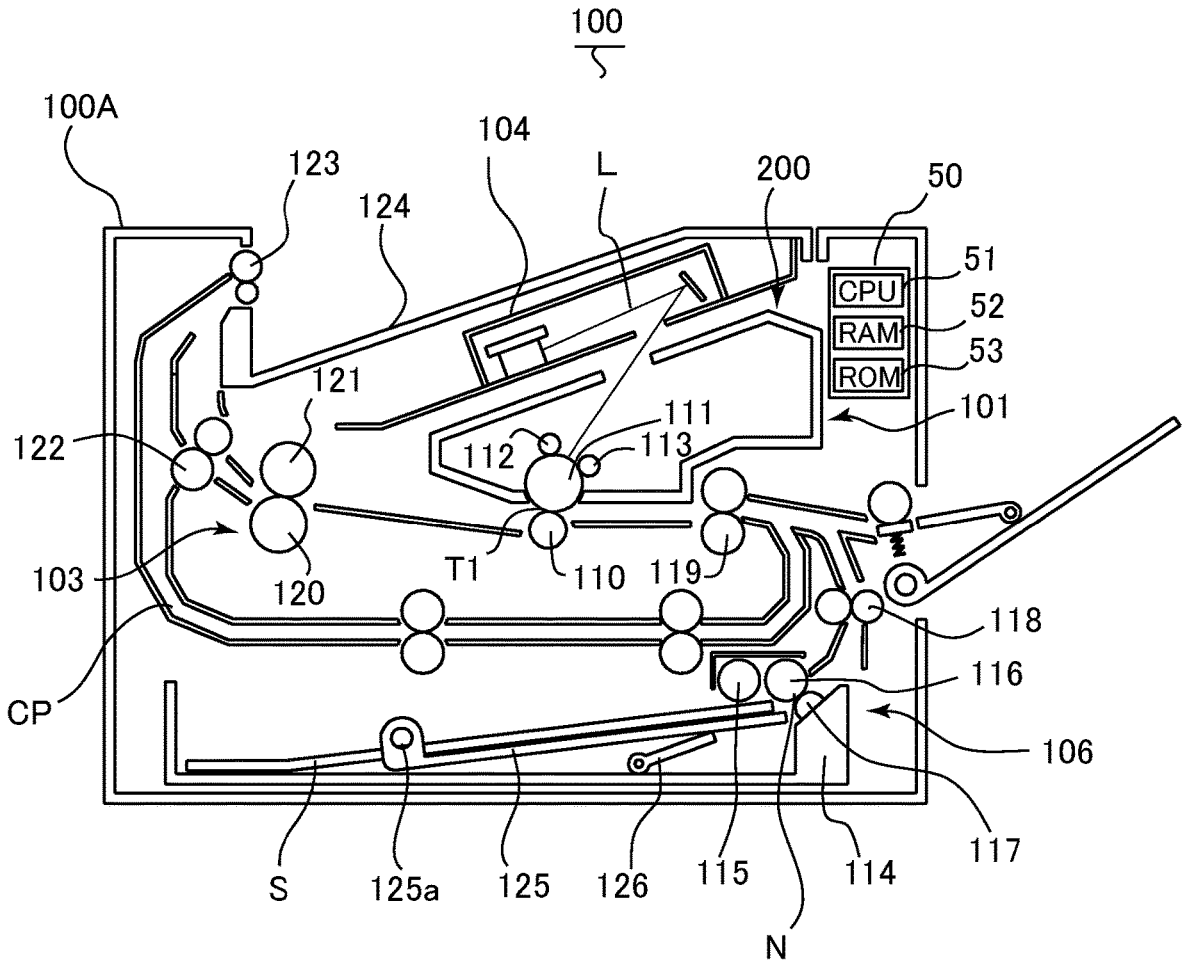
FIG. 1 is a schematic diagram illustrating a configuration of a printer of a first embodiment.

Firstly, a first embodiment of the present disclosure will be described. A printer 100 serving as an image forming apparatus is an electro-photographic laser beam printer configured to form a monochrome toner image. As illustrated in FIG. 1, the printer 100 includes a sheet feeding apparatus 106 configured to feed a stacked sheet and an image forming unit 101 configured to form an image on the sheet fed by the sheet feeding apparatus 106. The printer 100 also includes a fixing unit 103 configured to fix an image transferred onto the sheet and a sheet discharge roller pair 123 configured to discharge the sheet onto a sheet discharge tray 124.

As an image forming job is inputted to the printer 100, an image forming process of the image forming unit 101 is started based on image information inputted from an external computer or the like connected with the printer 100. The image forming unit 101 includes a process cartridge 200, a laser scanner 104 and a transfer roller 110. The process cartridge 200 includes a rotatable photosensitive drum 111 and a charger 112 and a developer 113 disposed around the photosensitive drum 111. The photosensitive drum 111 and the transfer roller 110 constitute a transfer nip T1. The process cartridge 200 is configured to be attachable/detachable to/from an apparatus body 100A of the printer 100.

The laser scanner 104 irradiates the photosensitive drum 111 with laser light L based on the inputted image information. Because the photosensitive drum 111 has been charged in advance by the charger 112 at this time, an electrostatic latent image is formed on the photosensitive drum 111 by the irradiation of the laser light. Then, the electrostatic latent image is developed by the developer 113 and a monochrome toner image is formed on the photosensitive drum 111.

In parallel with the image forming process described above, a sheet S is fed from the sheet feeding apparatus 106 serving as a sheet storage apparatus. The sheet feeding apparatus 106 includes a cassette 114 serving as a storage portion drawable/attachable out of/to the apparatus body 100A and a sheet supporting portion 125 configured to support the sheet S stored in the cassette 114 and to lift centering on a pivot shaft 125*a*. The sheet supporting portion 125 lifts up by being pressed up by a lifter 126. The sheet supporting portion 125 pivots upward as the image forming job is inputted, and an uppermost sheet stacked on the sheet supporting portion 125 comes into contact with a pickup roller 115 serving as a feed portion. Then, as the image forming job ends, the sheet supporting portion 125 pivots downward. Note that the sheet supporting portion 125 may be urged upward by a spring not illustrated for example and the sheet supporting portion 125 may be pressed downward against an urging force of the spring by a cam not illustrated every time when one sheet is fed.

The sheet S supported by the sheet supporting portion 125 is fed by the pickup roller 115 and is separated one by one at a separation nip N formed by a feed roller 116 and a separation roller 117.

The sheet S separated one by one at the separation nip N is conveyed to a registration roller pair 119 by a conveyance roller pair 118 and butts against the registration roller pair 119 being stopped to correct a skew thereof. Then, the registration roller pair 119 conveys the sheet S in synchronism with a toner image transfer timing at the transfer nip T1.

The toner image on the photosensitive drum 111 is transferred onto the sheet S conveyed by the registration roller pair 119 by an electrostatic loading bias applied to the transfer roller 110 at the transfer nip T1. Residual toner left on the photosensitive drum 111 is collected by a cleaning blade not illustrated. The fixing unit 103 applies predetermined heat and pressure to the sheet S onto which the toner image has been transferred to melt and fix the toner. The fixing unit 103 includes a pressure roller 120 and a heating roller 121 having a heater not illustrated. The sheet S that has passed through the fixing unit 103 is discharged onto a sheet discharge tray 124 by a conveyance roller pair 122 and a sheet discharge roller pair 123.

In a case of forming images on both surfaces of the sheet S, the sheet S in which an image has been formed on a first surface thereof is switched back by the sheet discharge roller pair 123 and is conveyed to a duplex conveyance path CP. The duplex conveyance path CP guides the sheet S again to the registration roller pair 119. Then, an image is formed on a second surface of the sheet S at the transfer nip T1 and is discharged onto the sheet discharge tray 124.

The printer 100 also includes a control portion 50. The control portion 50 includes a CPU 51, a RAM 52 and a ROM 53. The CPU 51 calculates by reading a program stored in the ROM 53. The RAM 52 is used as a work area of the CPU 51.

Peripheral Components of Cassette

Figure 2A:
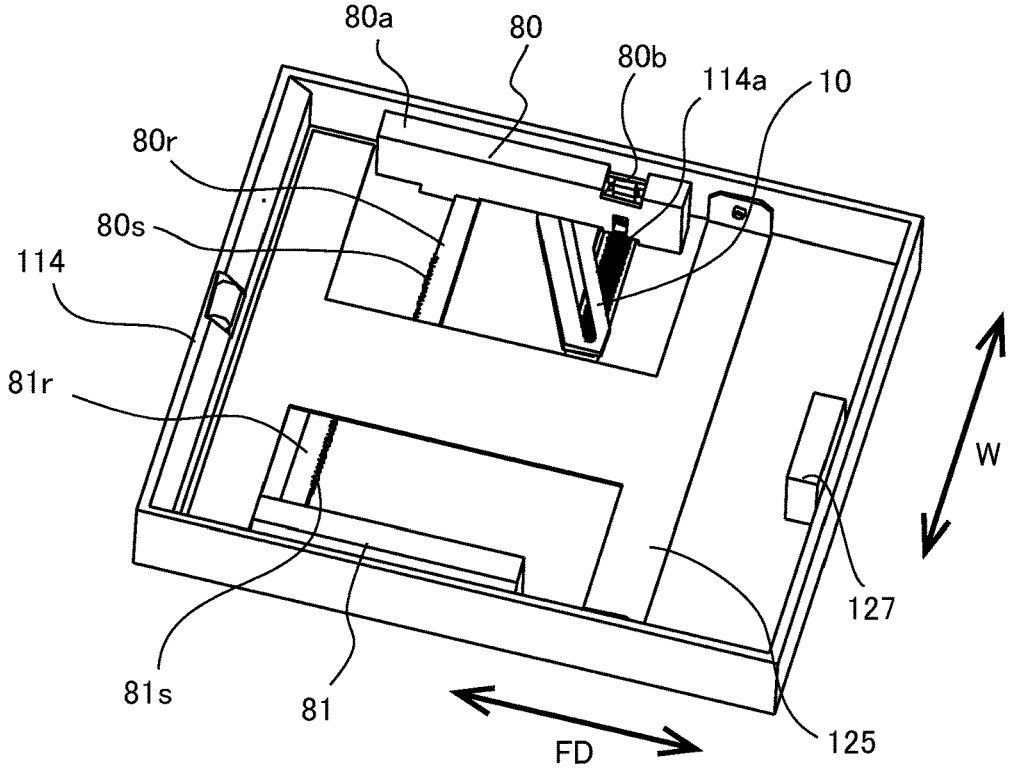
FIG. 2A is a perspective view illustrating a state of a cassette in aligning an LTR-sized sheet.

Next, peripheral components of the cassette 114 will be described with reference to FIGS. 2A through 3. FIG. 2A illustrates a position of side regulation members 80 and 81 in aligning a LTR-sized sheet, and FIG. 2B illustrates a position of the side regulation members 80 and 81 in aligning a 3×5-sized sheet.

Figure 2B:
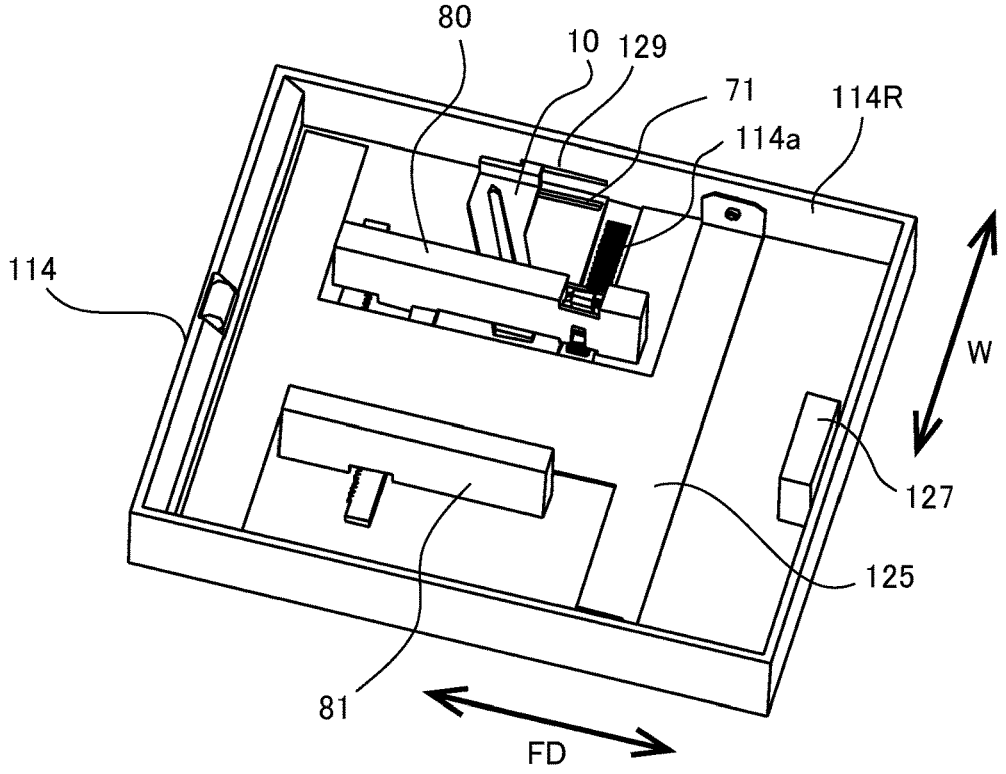
FIG. 2B is a perspective view illustrating a state of the cassette in aligning a 3×5-sized sheet.

As illustrated in FIGS. 2A and 2B, the cassette 114 supports the side regulation members 80 and 81 slidably in the width direction W. The side regulation members 80 and 81 are guided in the width direction W by a guide groove not illustrated and formed in the cassette 114. The cassette 114 also supports a trailing edge regulation member 127 movably in an attaching/detaching direction FD. The width direction W, i.e., a first direction, is a direction orthogonal to a feed direction of the sheet fed by the pickup roller 115. The attaching/detaching direction FD, i.e., a second direction, is a direction orthogonal to the width direction W and runs in parallel with the attaching/detaching direction of the cassette 114. Note that the attaching/detaching direction FD needs not to be orthogonal to the width direction W so long as it intersects with the width direction W.

The side regulation member 80 includes a body portion 80*a* configured to regulate a position of a widthwise end portion of the sheet stored in the cassette 114, an operating portion 80*b*, a lock portion 80*c* (see FIG. 3) and an interlocking portion 80*r* formed integrally with the body portion 80*a* and extending in the width direction W. The lock portion 80*c* of the side regulation member 80 is provided to be engageable with a rack gear 114*a* formed on a bottom surface of the cassette 114. The engagement of the lock portion 80*c* with the rack gear 114*a* can be released by operating the operating portion 80*b*.

That is, in a case where a user does not operate the operating portion 80*b*, the side regulation member 80 serving as a regulating portion is positioned by the engagement of the lock portion 80*c* with the rack gear 114*a*. Then, the side regulation member 80 can be moved in the width direction W in a state in which the user operates the operating portion 80*b* to release the engagement of the lock portion 80*c* with the rack gear 114*a*.

The side regulation member 81 also includes an interlocking portion 81*r* extending in the width direction W similarly to the side regulation member 80. The interlocking portions 80*r* and 81*r* include rack portions 80*s* and 81*s* configured to be engageable with each other through a pinion gear 128 (see FIG. 5). The side regulation members 80 and 81 are interlocked in a direction of approaching/separating to/away from each other in the width direction W by these interlocking portions 80*r* and 81*r* and the pinion gear 128.

Figure 3:
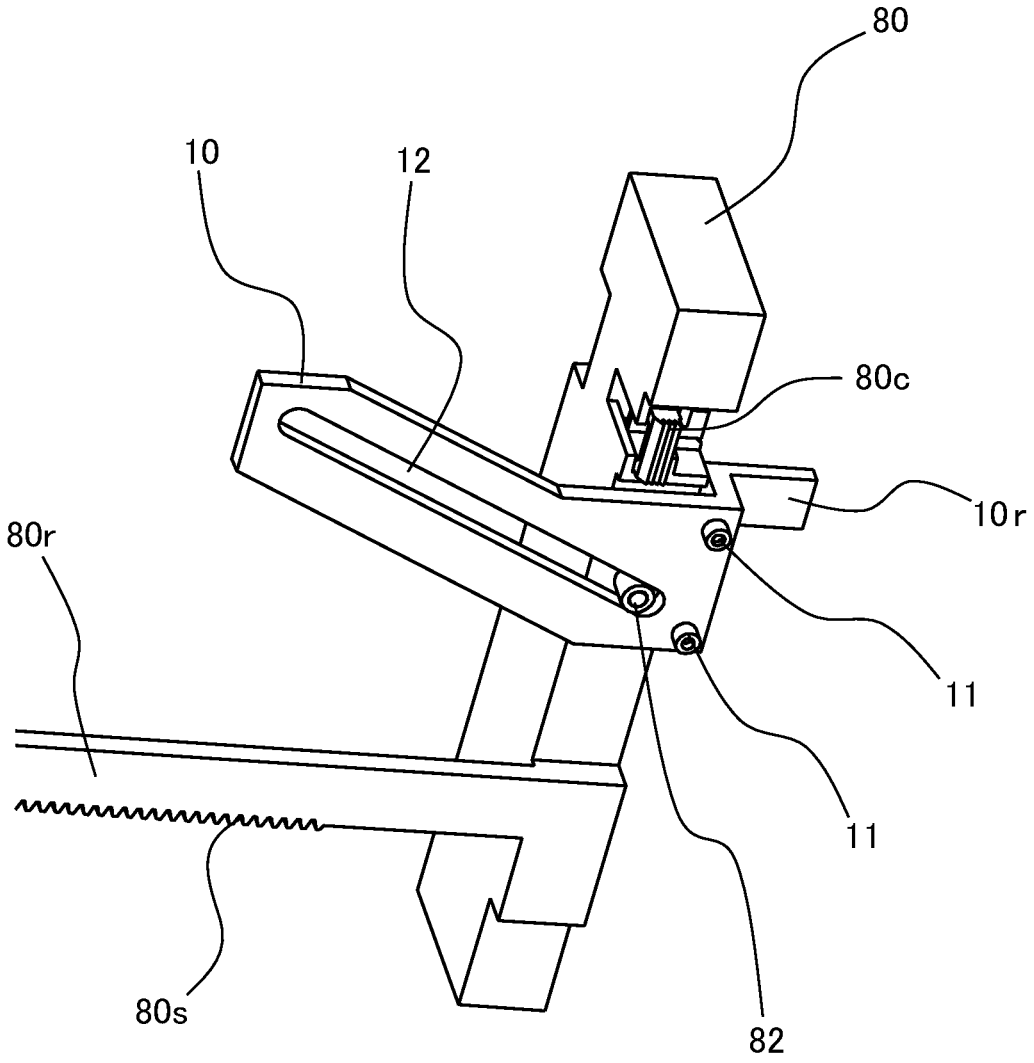
FIG. 3 is a perspective view, seen from a bottom, illustrating a cassette cam and a side regulation member.
Figure 4:
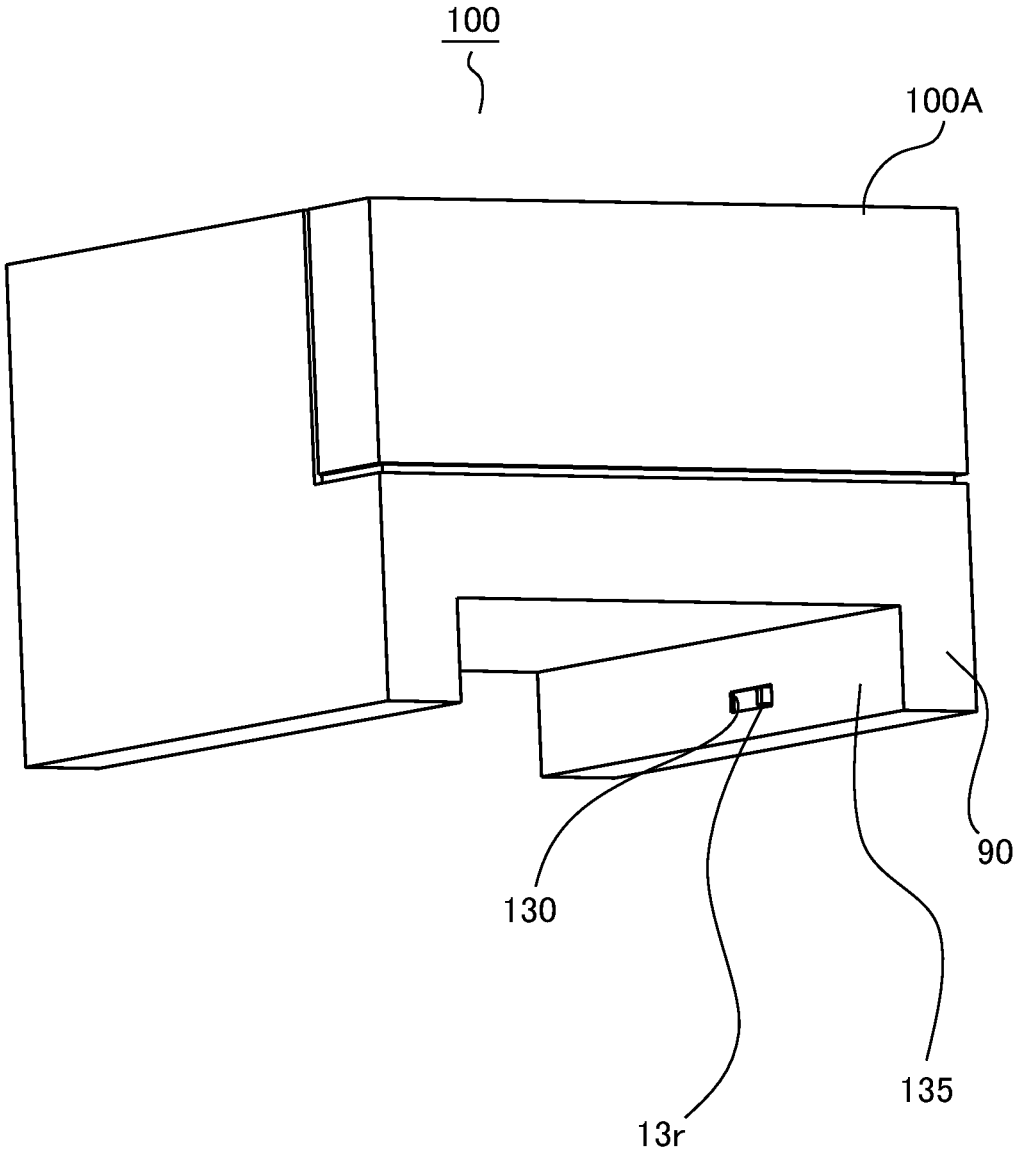
FIG. 4 is a perspective view illustrating an apparatus body.

Still further, as illustrated in FIGS. 2A through 3, a cassette cam 10 is disposed under the side regulation member 80. The cassette cam 10 includes two rollers 11 on an under surface thereof. The rollers 11 serving as first rotary members are supported slidably to a rail portion 71 of the cassette 114. The rail portion 71 extends in the attaching/detaching direction of the cassette 114. Note that the attaching/detaching direction of the cassette 114 includes a cassette draw-out direction and a cassette attachment direction.

The cassette cam 10 also includes a cam groove 12 extending in a direction intersecting with the attaching/detaching direction FD and the width direction W. More specifically, the cam groove 12 extends downstream in the attachment direction within the attaching/detaching direction FD as the cam groove 12 approaches outside in the width direction W. Engaged with the cam groove 12 is a roller 82 serving as a second rotary member provided on the under surface of the side regulation member 80. While all of the rollers 11 and 82 are composed of roller members rotatably supported centering on axes extending in a perpendicular direction, they may be composed of spherical bodies rotatable centering on a center line.

Because the roller 82 of the side regulation member 80 is engaged with the cam groove 12, the cassette cam 10 slidably moves in the draw-out direction of the cassette 114 along the rail portion 71 when the side regulation member 80 moves outside in the width direction W. The cassette cam 10 also slidably moves in the attachment direction of the cassette 114 along the rail portion 71 when the side regulation member 80 moves inside in the width direction W. That is, the cassette cam 10 serving as a cam member slidably moves in the attaching/detaching direction FD by interlocking with the move in the width direction W of the side regulation member 80.

Because the roller 82 of the side regulation member 80 slides along the cam groove 12 and the rollers 11 of the cassette cam 10 slide along the rail portion 71 when the cassette cam 10 moves, it is possible to reduce sliding resistance of these members. This arrangement enables to reduce an operating force required when the user moves the side regulation members 80 and 81. It is noted that these rollers 11 and 82 may be omitted.

The cassette cam 10 is provided with a rib portion 10*r* at an end portion in the width direction W thereof. The rib portion 10*r* penetrates through a long hole 129 defined through a right side plate 114R of the cassette 114 and projects out to a right side of the right side plate 114R. The long hole 129 extends in the attaching/detaching direction FD, and the rib portion 10*r* is movable in the attaching/detaching direction FD within a range of the long hole 129. That is, the rib portion 10*r* varies a position in the attaching/detaching direction FD corresponding to a position in the width direction W of the side regulation member 80.

Detection of Position of Side Regulating Member

Next, a configuration for detecting a position of the side regulation member 80 will be described with reference to FIGS. 4 through 8B. As illustrated in FIGS. 4 through 8B, provided at an under part of the apparatus body 100A is a lower frame 90 including a guide rail 135 for guiding the cassette 114 in drawing/attaching the cassette 114 out of/to the apparatus body 100A. A body cam 13, a variable resistor 14 and a printed board 15 are disposed within the lower frame 90.

The body cam 13 serving as a slide member is supported slidably in the attaching/detaching direction FD by supporting portions 91 provided within the lower frame 90 and is urged in the draw-out direction of the cassette 114 by a spring 17. The lower frame 90 is also provided with a rib 18, and the body cam 13 is positioned at a standby position by butting against the rib 18 while resisting against an urging force of the spring 17. That is, the body cam 13 is urged to the standby position by the spring 17 serving as an urging member.

The body cam 13 includes a rib portion 13*r* to be inserted into a hole 130 defined through the lower frame 90. The rib portion 13*r* is configured to be able to engage with the rib portion 10*r* of the cassette cam 10. That is, as the cassette 114 is attached to the apparatus body 100A, the rib portion 10*r* of the cassette cam 10 provided in the cassette 114 pushes the rib portion 13*r* of the body cam 13 positioned at the standby position in the attachment direction. In other words, the body cam 13 slidably moves in the attaching/detaching direction FD by engaging with the cassette cam 10 when the cassette 114 is attached to the apparatus body 100A. Thus, the rib portion 10*r* of the cassette cam 10 is disposed upstream of the rib portion 13*r* of the body cam 13 in terms of the attachment direction of the cassette 114.

Still further, the variable resistor 14 and the printed board 15 are supported by a holder not illustrated in the lower frame 90, and the variable resistor 14 is electrically connected with the printed board 15. The variable resistor 14 is a sliding-type variable resistor and includes a project portion 16 serving as a moving portion slidably movable in the attaching/detaching direction FD. The project portion 16 extends in the width direction W. A resistor not illustrated is disposed within the variable resistor 14, and a resistance value which is a detected value of the variable resistor 14 varies corresponding to a position in the attaching/detaching direction FD of the project portion 16. The variable resistor 14 serving as a sensor is electrically connected with a control portion 50 (see FIG. 1), and the control portion 50 detects a position of the side regulation member 80 as described later by transforming the resistance value of the variable resistor 14 into voltage. Note that instead of the variable resistor 14, a sensor whose detected value is a current value or a voltage value may be used.

Figure 5:
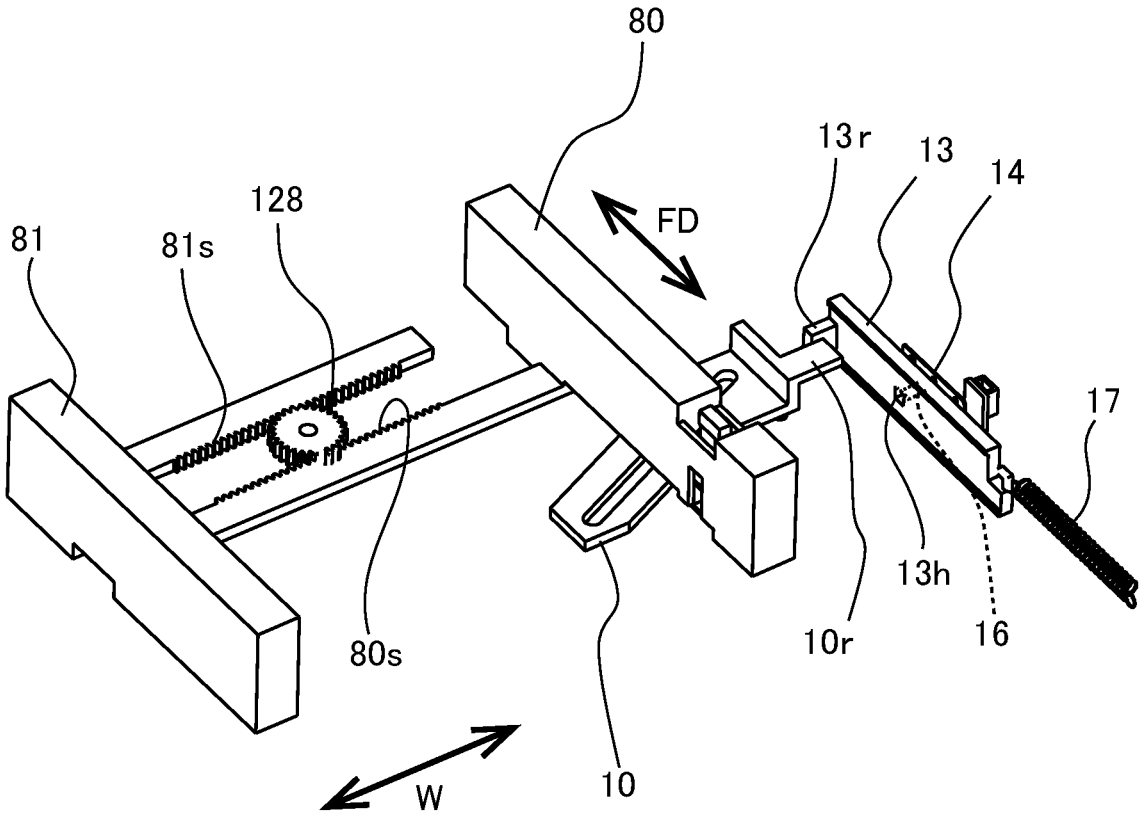
FIG. 5 is a perspective view illustrating the side regulation member, the cassette cam and a body cam.
Figure 6:
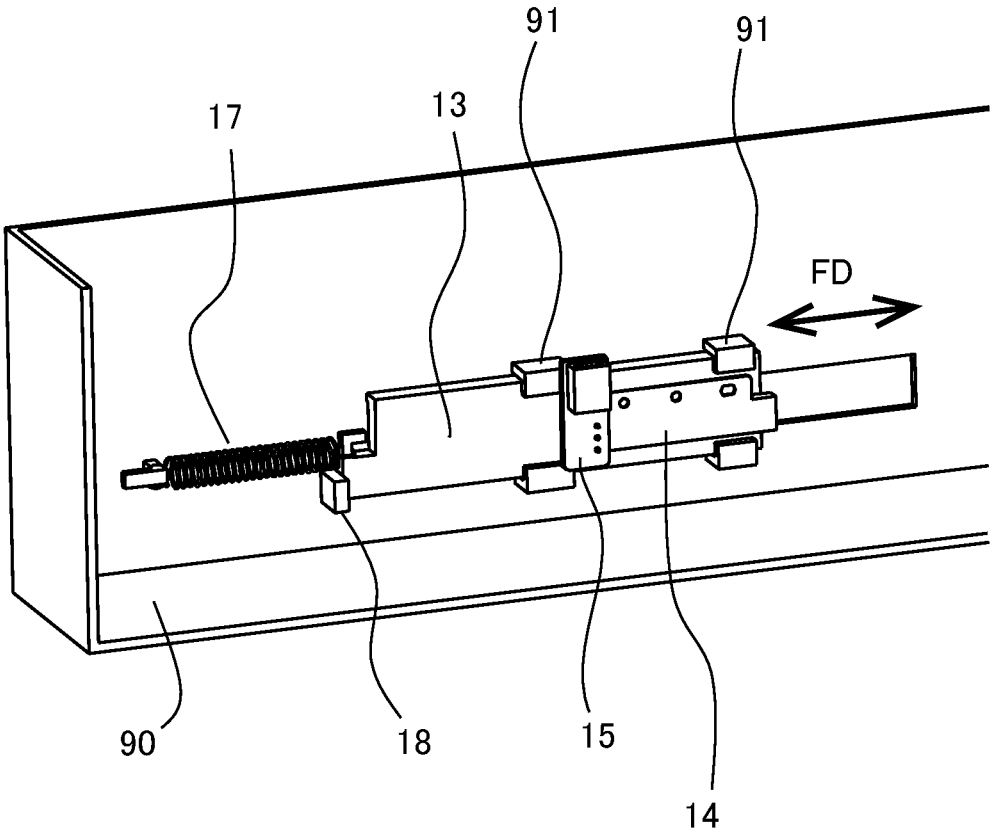
FIG. 6 is a perspective view illustrating the body cam and a variable resistor.
Figure 7A:
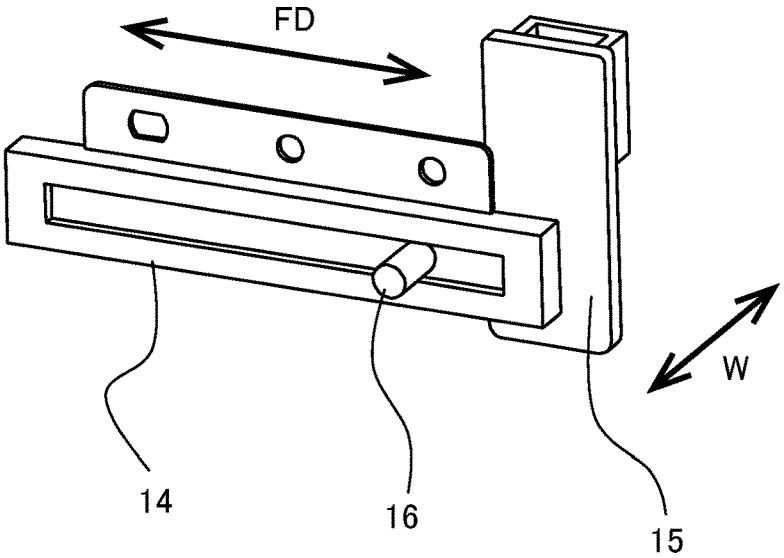
FIG. 7A is a perspective view illustrating the variable resistor.
Figure 7B:
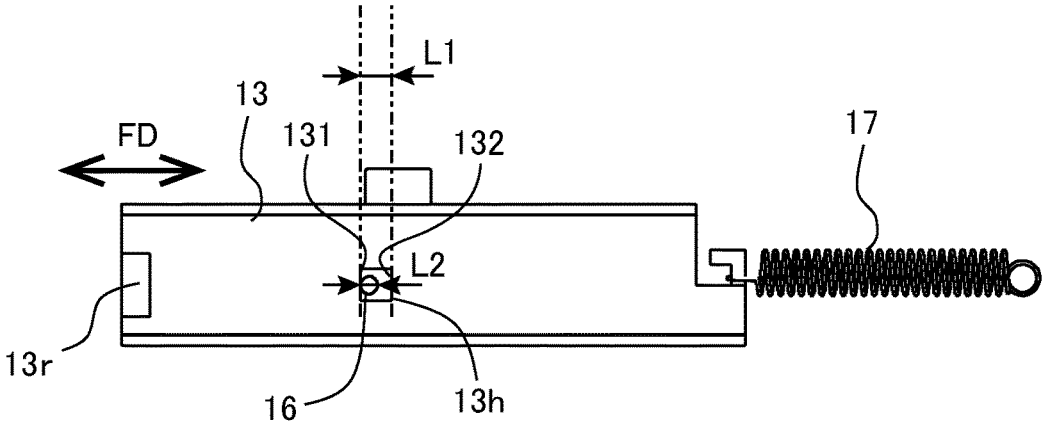
FIG. 7B is a side view illustrating the body cam and a project portion in a state in which the cassette is removed out of the apparatus body.
Figure 7C:
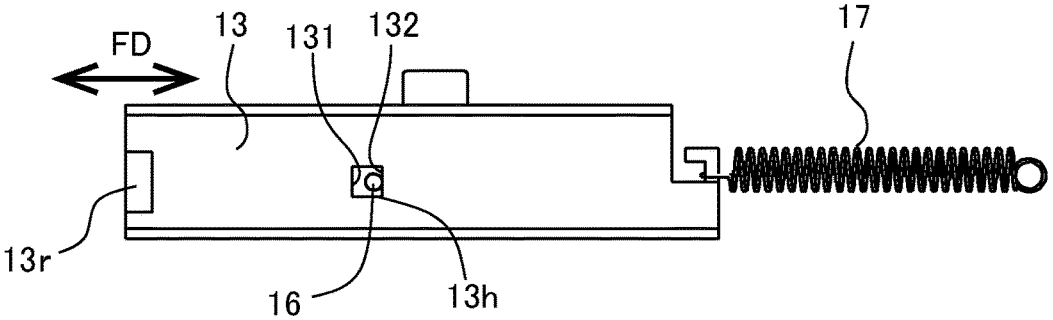
FIG. 7C is a side view illustrating the body cam and the project portion in a state in which the cassette is attached to the apparatus body.

As illustrated in FIGS. 5, 7B and 7C, the body cam 13 is provided with a hole portion 13*h* extending in the width direction W, and the project portion 16 of the variable resistor 14 is inserted into the hole portion 13*h* with a predetermined clearance. That is, as illustrated in FIG. 7B, a size L1 in the attaching/detaching direction FD of the hole portion 13*h* is greater than a size L2 in the attaching/detaching direction FD of the project portion 16. Note that because the project portion 16 is formed into a cylindrical shape in the present embodiment, the size L2 is equal with an outer diameter of the project portion 16. Because there is such clearance between the hole portion 13*h* and the project portion 16 as described above, the body cam 13 may be assembled with the variable resistor 14 readily without needing to position the hole portion 13*h* of the body cam 13 precisely to the project portion 16.

FIG. 7B is a side view illustrating a positional relationship between the hole portion 13*h* and the project portion 16 in a state in which the cassette 114 is removed out of the apparatus body 100A. FIG. 7C is a side view illustrating the positional relationship between the hole portion 13*h* and the project portion 16 in a state in which the cassette 114 is attached to the apparatus body 100A. As illustrated in FIG. 7B, the body cam 13 is positioned at the standby position by the spring 17 and the rib 18 in the state in which the cassette 114 is removed out of the apparatus body 100A.

At this time, the project portion 16 is in contact with a first end 131 of the hole portion 13*h* of the body cam 13. It is because a resilient force of the spring 17 charged when the rib portion 13*r* of the body cam 13 was pressed by the rib portion 10*r* of the cassette cam 10 is released by removing the cassette 114 out of the apparatus body 100A. As the resilient force of the spring 17 is released, the body cam 13 slidably moves in the draw-out direction of the cassette 114 toward the standby position. Thereby, the project portion 16 is pressed by the first end edge 131 of the hole portion 13*h* and is positioned at the home position.

Still further, as illustrated in FIG. 7C, the project portion 16 is in contact with a second end edge 132 of the hole portion 13*h* of the body cam 13 in the state in which the cassette 114 is attached to the apparatus body 100A. It is because the body cam 13 is pressed by the rib portion 10*r* of the cassette cam 10 provided in the cassette 114 in the attachment direction of the cassette 114 from the standby position in attaching the cassette 114 to the apparatus body 100A. Because the body cam 13 moves in the attachment direction of the cassette 114 against the urging force of the spring 17, the project portion 16 is pressed by the second end edge 132 of the hole portion 13*h* and is positioned at a predetermined position corresponding to positions of the side regulation members 80 and 81.

Figure 8A:
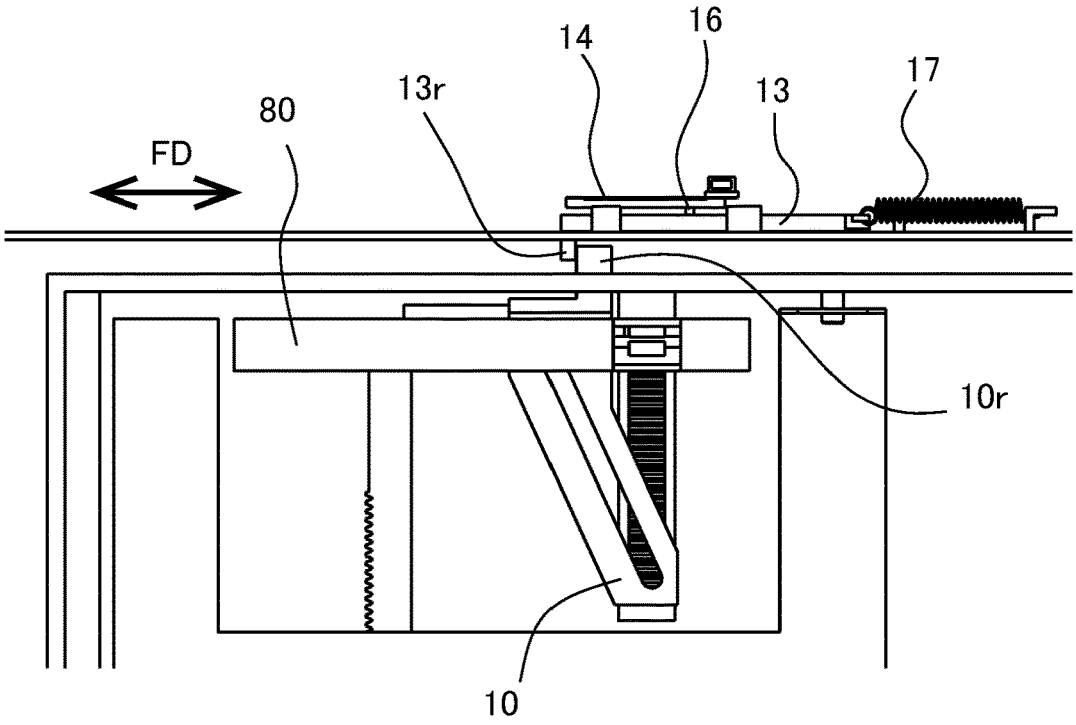
FIG. 8A is a plan view illustrating a state in which the side regulation member is set at a position corresponding to the LTR-sized sheet.
Figure 8B:
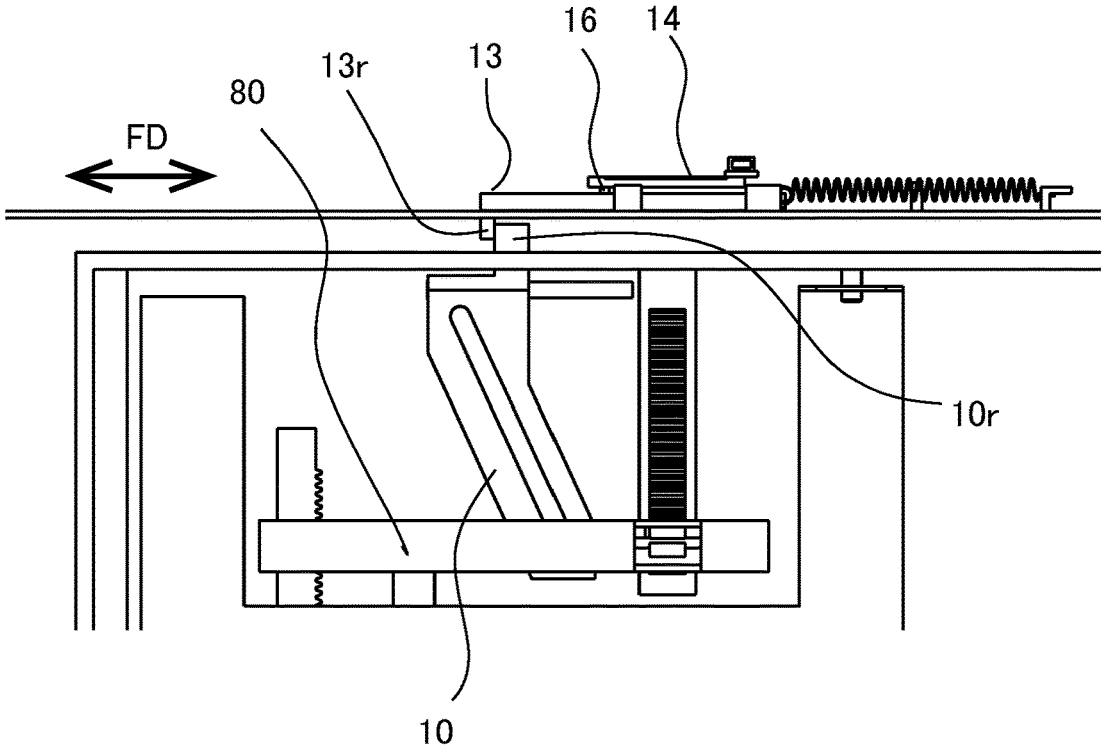
FIG. 8B is a plan view illustrating a state in which the side regulation member is set at a position corresponding to the 3×5-sized sheet.

FIG. 8A is a plan view illustrating a state in which the side regulation member 80 is set at a position corresponding to the LTR-sized sheet and FIG. 8B is a plan view illustrating a state in which the side regulation member 80 is set at a position corresponding to the 3×5-sized sheet. As described above, as the cassette 114 is attached to the apparatus body 100A, the rib portion 10*r* of the cassette cam 10 comes into contact with the rib portion 13*r* of the body cam 13 on a way of the operation of attaching the cassette 114. Then, the cassette 114 is attached further to the apparatus body 100A, so that the rib portion 10*r* of the cassette cam 10 pushes the rib portion 13*r* of the body cam 13 in the attachment direction. Thereby, the body cam 13 moves in the attachment direction of the cassette 114 and the project portion 16 of the variable resistor 14 also slidably moves.

As illustrated in FIGS. 8A and 8B, a position in the attaching/detaching direction FD of the rib portion 10*r* of the cassette cam 10 differs depending on a position of the side regulation member 80. Therefore, a position of the project portion 16, when the cassette 114 is attached to the apparatus body 100A, varies depending on the position of the side regulation member 80. Note that the rib portion 10*r* of the cassette cam 10 receives a reaction force in the draw-out direction of the cassette 114 from the rib portion 13*r* of the body cam 13. However, because the side regulation members 80 and 81 abut with the sheet within the cassette 114, the move in the draw-out direction of the cassette 114 of the cassette cam 10 is regulated.

Figure 9:
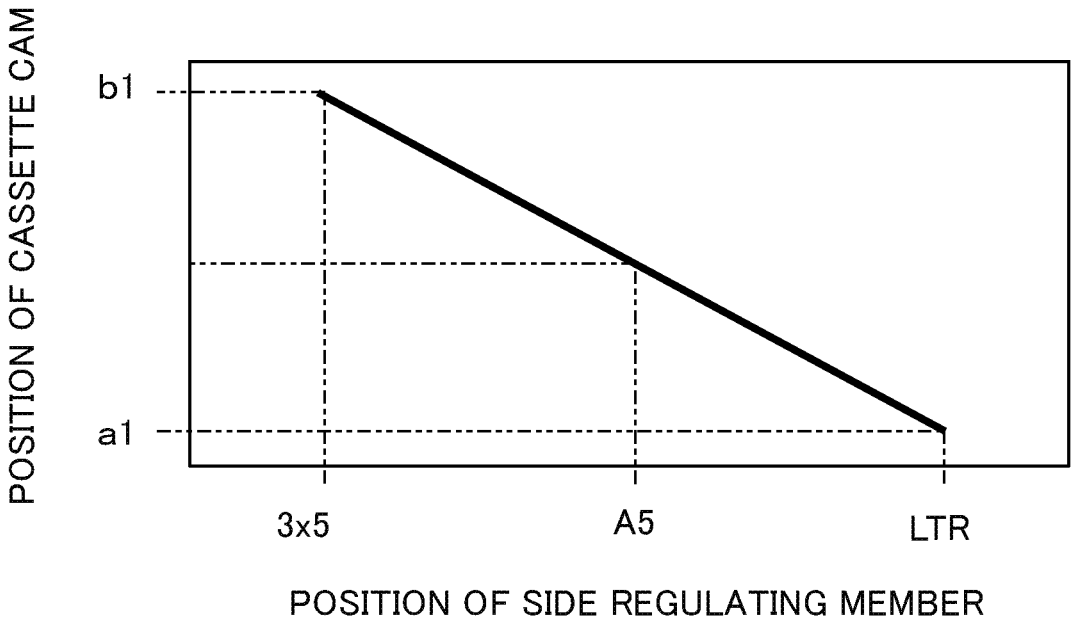
FIG. 9 is a graph indicating a positional relationship between the side regulation member and the cassette cam.

FIG. 9 is a graph indicating a positional relationship between the side regulation member 80 and the cassette cam 10. An axis of abscissa of the graph in FIG. 9 represents a position of the side regulation member 80 and an axis of ordinate represents a position of the cassette cam 10. In a case where the side regulation member 80 is positioned at a position corresponding to the LTR-sized sheet, the cassette cam 10 is positioned at a position a1. In a case where the side regulation member 80 is positioned at a position corresponding to the 3×5-sized sheet, the cassette cam 10 is positioned at a position b1.

Because the cam groove 12 provided in the cassette cam 10 is formed straightly across an entire length thereof, the positional relationship between the side regulation member 80 and the cassette cam 10 is linear, and the variable resistor 14 can detect the position of the side regulation member 80 continuously.

Conclusion of First Embodiment

As described above, according to the present embodiment, it is possible to convert the widthwise position of the side regulation member 80 into a position in the attaching/detaching direction FD of the project portion 16 of the variable resistor 14 by the cassette cam 10 and the body cam 13. Therefore, even if the variable resistor 14 and the side regulation member 80 are disposed such that a longitudinal direction of the variable resistor 14 intersects with the moving direction, i.e., the width direction W, of the side regulation member 80, it is possible to accurately detect the position of the side regulation member 80. It is also possible to construct the apparatus in compact by arranging the longitudinal direction of the variable resistor 14 along the attaching/detaching direction FD of the cassette 114. It is also possible to detect the position of the side regulation member 80 steplessly.

Still further, because the position of the side regulation member 80 is transmitted to the apparatus body 100A side directly by the cassette cam 10, component allowance is hardly added to the detected value and the position of the side regulation member 80 can be detected accurately. Still further, because the variable resistor 14 is disposed on the apparatus body 100A side, routing to the variable resistor 14 can be readily made.

Still further, because it is possible to judge the size of the sheet stored in the cassette 114 automatically from the position of the side regulation member 80 just by attaching the cassette 114 to the apparatus body 100A, it is unnecessary to operate the operating portion of the printer 100 for example to set the size of the sheet. This improves usability. Still further, because sliding resistance between components is reduced by the rollers 11 and 82, it is possible to reduce an operating force of the user in moving the side regulation members 80 and 81.

Still further, as the cassette 114 is drawn out of the apparatus body 100A, the project portion 16 of the variable resistor 14 returns automatically to the home position by the action of the spring 17 and the body cam 13. Therefore, it is possible to judge that the cassette 114 is drawn out of the apparatus body 100A when the project portion 16 is positioned at the home position. This arrangement makes it possible to downsize the apparatus and to cut costs of the apparatus because the draw-out state and the attachment state of the cassette 114 and the position of the side regulation member 80 can be detected just by one variable resistor 14.

Second Embodiment

Next, a second embodiment of the present disclosure will be described. The second embodiment is what the configuration of the cam groove of the cassette cam of the first embodiment is modified. Therefore, the same components with those of the first embodiment will be described while omitting their illustrations or by denoting the same reference signs.

Figure 10:
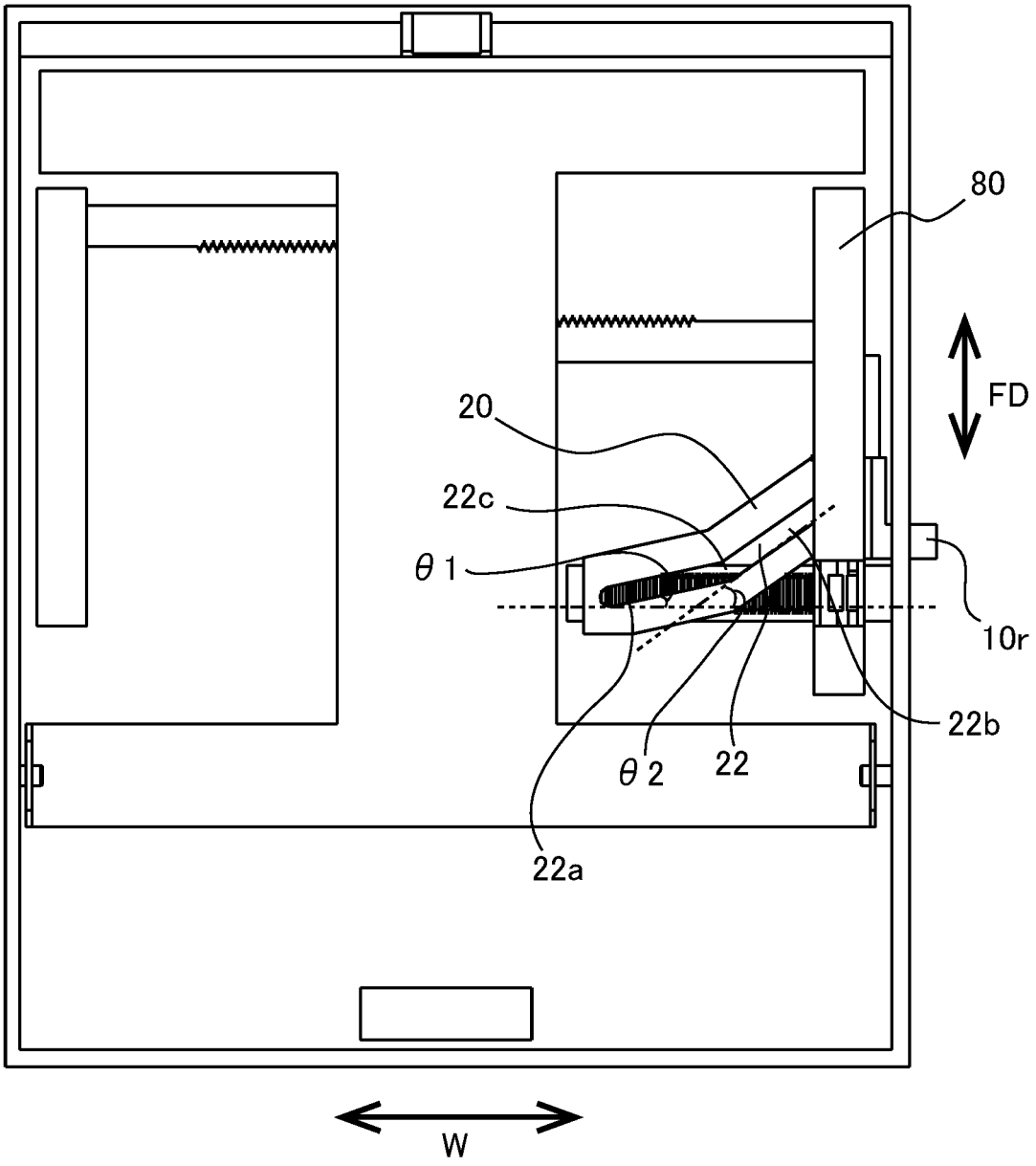
FIG. 10 is a plan view illustrating a cassette cam of a second embodiment.

As illustrated in FIG. 10, a cassette cam 20 serving as a cam member of the present embodiment varies a position in the attaching/detaching direction FD corresponding to a widthwise position of the side regulation member 80 similarly to the first embodiment. The cassette cam 20 includes a cam groove 22 extending in a direction of intersecting with the attaching/detaching direction FD and with the width direction W.

The cam groove 22 is formed into a shape of 'letter L' as a whole and includes a first cam groove 22*a* and a second cam groove 22*b*. The first cam groove 22*a* and the second cam groove 22*b* extend in the attachment direction of the cassette 114 as the first cam groove 22*a* and the second cam groove 22*b* extend outside in the width direction W. When viewed in plan, an inclination angle of the first cam groove 22*a* to the width direction W is a first angle θ1 and an inclination angle of the second cam groove 22*b* is a second angle θ2 which is greater than the first angle θ1.

Figure 11:
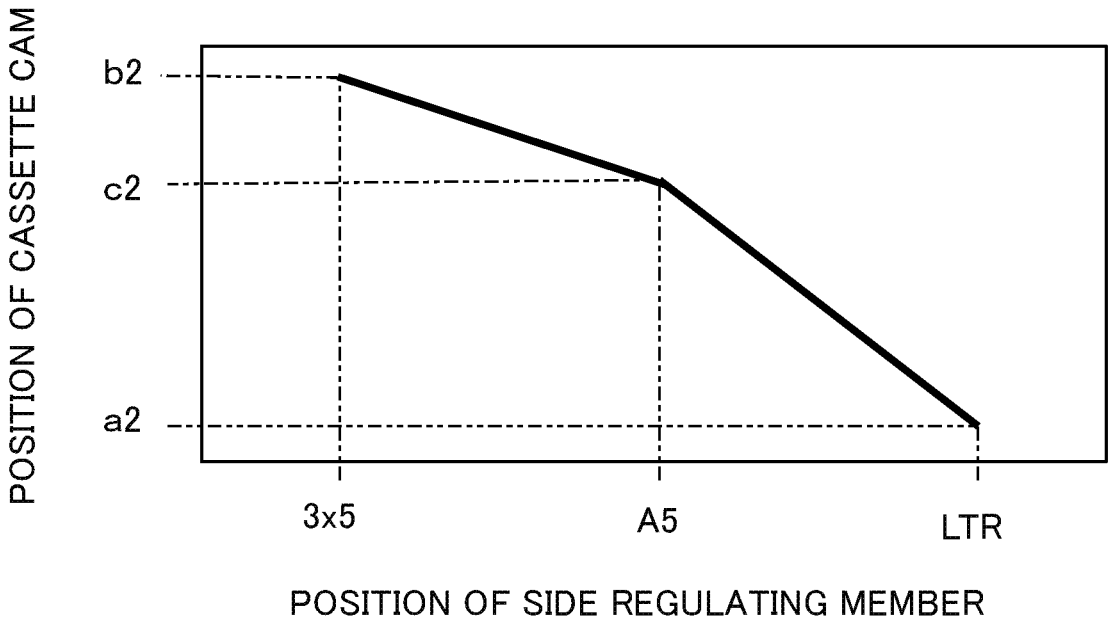
FIG. 11 is a graph indicating a positional relationship between the side regulation member and the cassette cam.

FIG. 11 is a graph indicating a positional relationship between the side regulation member 80 and the cassette cam 20. In the graph in FIG. 11, an axis of abscissa represents a position of the side regulation member 80 and an axis of ordinate represents a position of the cassette cam 20. When the side regulation member 80 is positioned at a position corresponding to the LTR-sized sheet, the cassette cam 20 is positioned at a position a2. When the side regulation member 80 is positioned at a position corresponding to an A5-sized sheet, the cassette cam 20 is positioned at a position c2. When the side regulation member 80 is positioned at a position corresponding to a 3×5-sized sheet, the cassette cam 20 is positioned at a position b2. Then, when the side regulation member 80 is engaged at a flexion point 22*c* between the first and second cam grooves 22*a* and 22*b* of the cam groove 22, the side regulation member 80 is positioned at the position corresponding to the A5-sized sheet.

Because the first cam groove 22*a* and the second cam groove 22*b* of the cam groove 22 are straight, respectively, the positional relationship between the side regulation member 80 and the cassette cam 20 is linear and the variable resistor 14 can detect the position of the side regulation member 80 continuously. Still further, when inclinations of the graph in FIG. 11 are compared, an inclination between the positions a2 to c2 is greater than an inclination between the positions c2 to b2. That is, because a moving amount of the cassette cam 20 increases with respect to a moving amount of the side regulation member 80, it is possible to improve detection accuracy between the positions a2 to c2. In a case where many users are supposed to use the LTR-sized sheet through the A5-sized sheet, it is possible to improve the detection accuracy of the LTR-sized sheet through the A5-sized sheet by forming the cam groove 22 into the 'letter L' like the present embodiment.

It is noted that while the cam groove 22 is formed into the 'letter L' in the present embodiment, the cam groove 22 is not limited to that shape and may be formed into a circular arc shape or a spline shape for example. Still further, it is possible to change a size of a sheet for which detection accuracy is desirable to be improved by arbitrarily setting the inclination of the cam groove 22. It is possible to appropriately set a range of a sheet size for which the detection accuracy is to be improved by not monotonously setting the inclination of the cam groove 22 as described above.

Third Embodiment

Next, a third embodiment of the present disclosure will be described. The third embodiment is what the variable resistor of the first embodiment is modified not to be slidable but to be rotatable. Therefore, the same components with those of the first embodiment will be described while omitting their illustrations or by denoting the same reference signs.

Figure 12A:
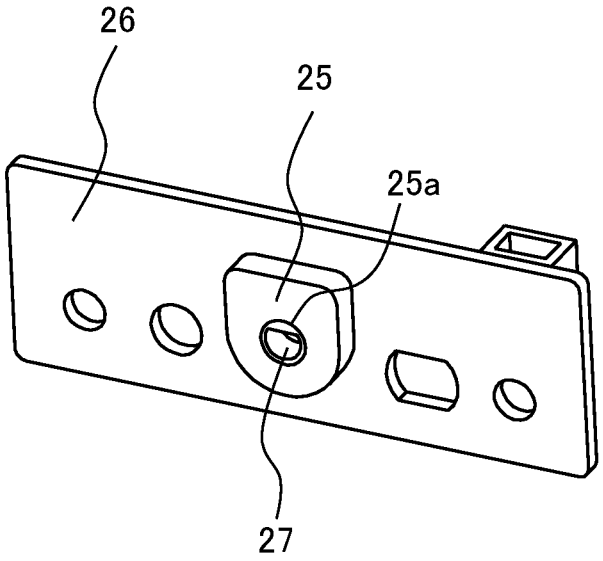
FIG. 12A is a perspective view illustrating a variable resistor of a third embodiment.

As illustrated in FIG. 12A, a variable resistor 25 serving as a sensor of the present embodiment is electrically connected with a printed board 26 which is positioned by a holder not illustrated. The variable resistor 25 includes a rotary member 25*a* having a D-cut shaped hole 27 and varies a resistance value corresponding to a rotational phase of the rotary member 25*a*. Note that a sensor whose detected value is a current value or a voltage value may be used instead of the variable resistor 25.

Figure 12B:
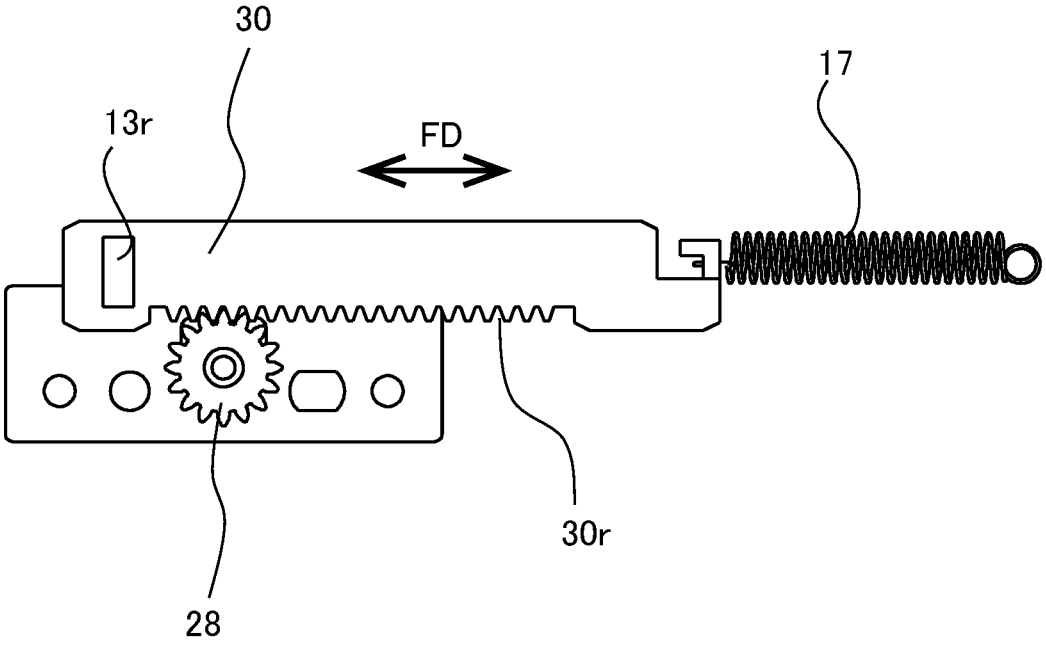
FIG. 12B is a perspective view illustrating a body cam and a pinion gear.

As illustrated in FIG. 12B, a body cam 30 serving as a slide member slidably moving in the attaching/detaching direction FD by engaging with the cassette cam is provided with a rack gear 30*r* serving as a rack portion extending in the attaching/detaching direction FD. The rack gear 30*r* meshes with a pinion gear 28. One shaft of the pinion gear 28 serving as a gear portion is supported rotatably by the lower frame 90 and another shaft is fixed to the hole 27. Note that the cassette cam 10 of the first embodiment or the cassette cam 20 of the second embodiment is applicable to the cassette cam of the present embodiment.

Then, when the body cam 30 slidably moves, the rotary member 25*a* of the variable resistor 25 rotates together with the pinion gear 28, and the resistance value of the variable resistor 25 varies corresponding to a rotational phase of the rotary member 25*a*. That is, the rotary member 25*a* rotates in response to the movement of the attaching/detaching direction FD of the body cam 30. The control portion 50 (see FIG. 1) can detect the position of the side regulation member 80 by detecting by converting the resistance value to a voltage. It is possible to downsize the apparatus by modifying the variable resistor 25 as the rotary variable resistor as described above.

Other Examples

Note that while the cassette cam is provided with the rollers 11 and the side regulation member 80 is provided with the roller 82 in the embodiments described above, the present disclosure is not limited to such configuration. For instance, the rollers 11 may be provided in the cassette 114 and the roller 82 may be provided in the cassette cam. That is, the roller may be provided at one of the side regulation member 80 and the cassette cam and may slide to the other of the side regulation member 80 and the cassette cam when the side regulation member 80 moves slidably in the width direction W. Still further, the roller may be provided at one of the cassette cam and the cassette 114 and may slide to the other of the cassette cam and the cassette 114 when the cassette cam moves slidably in the attaching/detaching direction FD.

Still further, while the cassette cam includes the cam groove in the embodiments described above, the present disclosure is not limited to such configuration. That is, the cassette cam may be constructed in any manner as far as the cassette cam engages with the side regulation member 80 and moves in a direction intersecting with a move direction of the side regulation member 80. For instance, the cassette cam may be engaged with the side regulation member 80 not by the cam groove but by a guide rib.

Still further, while the printer 100 detects the position of the side regulation member 80 in the embodiments described above, the present disclosure is not limited to such configuration. For instance, it is possible to detect a position of a trailing edge regulation member 127 serving as a regulating portion, instead of the side regulation member 80, by using the cassette cam, the body cam and the variable resistor.

Still further, while the present disclosure is applied to the sheet feeding apparatus 106 provided within the printer 100 in the embodiments described above, the present disclosure is not limited to such configuration. For instance, the present disclosure is also applicable to a sheet storage apparatus such as a large capacity stacker connected with the apparatus body 100A of the printer 100 and configured to store sheets. In this case, the sheet storage apparatus may be provided with a control portion to detect sizes of the sheets within the sheet storage apparatus. Still further, the apparatus body 100A includes at least a casing of the sheet storage apparatus. In a case where the present disclosure is applied to an option feeder for example, the apparatus body 100A may be a casing of the option feeder.

While all of the embodiments described above have been described by using the electro-photographic printer 100, the present disclosure is not limited to such configuration. For instance, the present disclosure is also applicable to an inkjet type image forming apparatus configured to form an image on a sheet by discharging ink drops out of a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-116799, filed Jun. 24, 2019, which is hereby incorporated by reference herein in its entirety.

What is claimed is:

1. A sheet storage apparatus, comprising:

an apparatus body;

a storage portion configured to be attachable/detachable to/from the apparatus body and to store a sheet;

a regulating portion configured to slidably move in a first direction with respect to the storage portion and to regulate a position of an end portion, in the first direction, of the sheet stored in the storage portion;

a cam member supported on the storage portion and configured to slidably move in a second direction by interlocking with a movement of the regulating portion in the first direction, the second direction intersecting with the first direction and being along an attaching/detaching direction of the storage portion;

a slide member supported on the apparatus body and configured to slidably move in the second direction by engaging with the cam member in a case where the storage portion is attached to the apparatus body, the slide member being separated from the cam member in a case where the storage portion is detached from the apparatus body, the cam member being a single member configured to slidably move in the second direction and simultaneously engage with the regulating portion and the slide member; and a sensor comprising a moving portion supported on the apparatus body and configured to move in the second direction by engaging with the slide member, and a variable resistor, supported on the apparatus body, whose resistance value varies in response to a position of the moving portion in the second direction, the sensor outputting a detection value that varies in response to the resistance value of the variable resistor, the sensor being disposed in the apparatus body and separated from the storage portion in a case where the storage portion is detached from the apparatus body, wherein the cam member comprises a cam groove extending in a direction intersecting with the first direction and the second direction, and engaging with the regulating portion.

2. The sheet storage apparatus according to claim 1, wherein the slide member includes a hole portion into which the moving portion is inserted, and wherein a size in the second direction of the hole portion is greater than a size in the second direction of the moving portion.

3. The sheet storage apparatus according to claim 1, wherein one of the cam member and the storage portion comprises a first rotary member that rotates while sliding with respect to the other of the cam member and the storage portion in a case where the cam member slidably moves in the second direction.

4. The sheet storage apparatus according to claim 1, wherein one of the regulating portion and the cam member comprises a second rotary member that rotates while sliding with respect to the other of the regulating portion and the cam member in a case where the regulating portion moves slidably in the first direction.

5. The sheet storage apparatus according to claim 1, further comprising an urging member configured to urge the slide member to a standby position, wherein the slide member moves slidably in the second direction from the standby position against an urging force of the urging member by being pressed by the cam member in a case where the storage portion is attached to the apparatus body.

6. The sheet storage apparatus according to claim 1, wherein the cam groove is formed straightly across an entire length thereof.

7. The sheet storage apparatus according to claim 1, wherein the cam groove comprises a first cam groove having a first angle of an inclination angle to the first direction and a second cam groove having a second angle of an inclination angle to the first direction which is greater than the first angle.

8. The sheet storage apparatus according to claim 1, further comprising a feed portion configured to feed a sheet stored in the storage portion in a feed direction, and wherein the first direction is a direction orthogonal to the feed direction.

9. An image forming apparatus comprising:

the sheet storage apparatus as set forth in claim 1; and an image forming unit configured to form an image on a sheet fed from the sheet storage apparatus.

10. The sheet storage apparatus according to claim 1, wherein the cam member comprises a projecting portion configured to engage with the slide member, wherein the projecting portion positions at a first position in a case where the regulating portion regulates a position of the end portion of the sheet which has a first size, and positions at a second position further upstream than the first position in an attachment direction in which the storage portion attaches to the apparatus body in a case where the regulating portion regulates a position of the end portion of the sheet which has a second size larger than the first size.

11. A sheet storage apparatus comprising:

an apparatus body;

a storage portion configured to be attachable/detachable to/from the apparatus body and to store a sheet;

a regulating portion configured to slidably move in a first direction with respect to the storage portion and to regulate a position of an end portion in the first direction of the sheet stored in the storage portion;

a cam member supported on the storage portion and configured to slidably move in a second direction by interlocking with a movement of the regulating portion in the first direction, the second direction intersecting with the first direction and being along an attaching/detaching direction of the storage portion;

a slide member supported on the apparatus body and configured to slidably move in the second direction by engaging with the cam member in a case where the storage portion is attached to the apparatus body, the slide member being separated from the cam member in a case where the storage portion is detached from the apparatus body, the cam member being a single member configured to slidably move in the second direction and simultaneously engage with the regulating portion and the slide member; and a sensor comprising a rotary member supported on the apparatus body and configured to rotate by a movement of the slide member in the second direction, and a variable resistor, supported on the apparatus body, whose resistance value varies in response to a rotational phase of the rotary member, the sensor outputting a detection value in response to the resistance value of the variable resistor, the sensor being disposed in the apparatus body and separated from the storage portion in a case where the storage portion is detached from the apparatus body, wherein the cam member comprises a cam groove extending in a direction intersecting with the first direction and the second direction, and engaging with the regulating portion.

12. The sheet storage apparatus according to claim 11, further comprising a gear portion fixed to the rotary member, wherein the slide member comprises a rack portion extending in the second direction and meshing with the gear portion.

13. The sheet storage apparatus according to claim 11, further comprising an urging member configured to urge the slide member to a standby position, wherein the slide member moves slidably in the second direction from the standby position against an urging force of the urging member by being pressed by the cam member in a case where the storage portion is attached to the apparatus body.

14. The sheet storage apparatus according to claim 11, wherein the cam groove is formed straightly across an entire length thereof.

15. The sheet storage apparatus according to claim 11, wherein the cam groove comprises a first cam groove having a first angle of an inclination angle to the first direction and a second cam groove having a second angle of an inclination angle to the first direction which is greater than the first angle.

16. The sheet storage apparatus according to claim 11, further comprising a feed portion configured to feed a sheet stored in the storage portion in a feed direction, wherein the first direction is a direction orthogonal to the feed direction.

17. An image forming apparatus comprising:

the sheet storage apparatus as set forth in claim 11; and an image forming unit configured to form an image on a sheet fed from the sheet storage apparatus.

18. The sheet storage apparatus according to claim 11, wherein the cam member comprises a projecting portion configured to engage with the slide member, wherein the projecting portion positions at a first position in a case where the regulating portion regulates a position of the end portion of the sheet which has a first size, and positions at a second position further upstream than the first position in an attachment direction in which the storage portion attaches to the apparatus body in a case where the regulating portion regulates a position of the end portion of the sheet which has a second size larger than the first size.

* * * * *